United States Patent [19]

Degen

[11] Patent Number: 4,703,526

[45] Date of Patent: Nov. 3, 1987

[54] UNDERMATTRESS USING PAIRED SLATS AND AN ELASTIC SUPPORTING MEMBER

[75] Inventor: Hugo Degen, Seltisberg, Switzerland

[73] Assignee: Marpal AG, Chur, Switzerland

[21] Appl. No.: 898,933

[22] Filed: Aug. 21, 1986

[30] Foreign Application Priority Data

Sep. 3, 1985 [CH] Switzerland ..... 3788/85

[51] Int. Cl.[4] ..... A47C 23/06

[52] U.S. Cl. ..... 5/237; 5/238; 5/258; 5/468

[58] Field of Search ..... 5/191, 236 R–239, 5/258, 468; 297/453

[56] References Cited

U.S. PATENT DOCUMENTS

| | | | |
|---|---|---|---|
| 51,981 | 1/1866 | Todd | 5/258 |
| 66,849 | 7/1867 | Johnson | 5/258 |
| 2,349,839 | 5/1944 | Apicella | 5/237 |
| 4,222,134 | 9/1980 | Deyen | 5/238 |
| 4,567,615 | 2/1986 | Fanti | 5/237 |
| 4,573,226 | 3/1986 | Wittmann et al. | 5/237 |

FOREIGN PATENT DOCUMENTS

| | | |
|---|---|---|
| 2931512 | 3/1980 | Fed. Rep. of Germany . |
| 7916324 | 1/1980 | France . |

*Primary Examiner*—Gary L. Smith
*Assistant Examiner*—Michael F. Trettel
*Attorney, Agent, or Firm*—Ralph W. Selitto, Jr.

[57] ABSTRACT

The spring bridges of an undermattress are provided with lifting slats (9) which lift the unloaded mattress during the day for the purpose of better airing of the plywood springs (4, 5). During loading by a reclining person, the lifting slats (9) fall back below the upper edge of the plywood springs (4, 5) so that the mattress is then supported normally.

11 Claims, 12 Drawing Figures

Figure 1:
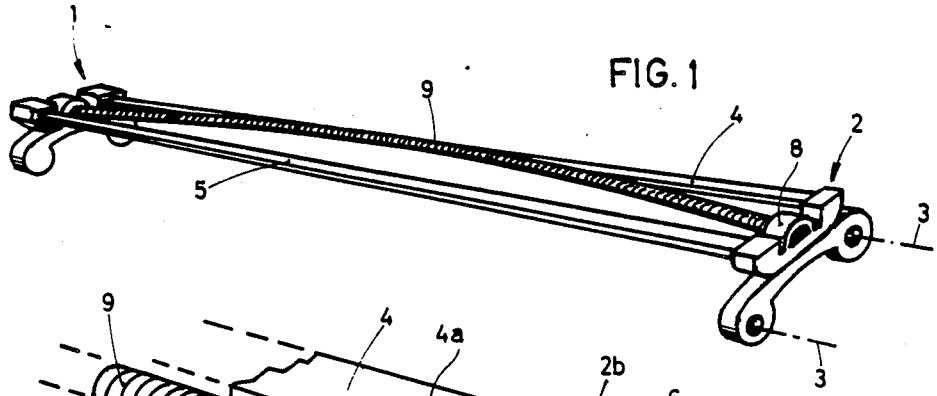

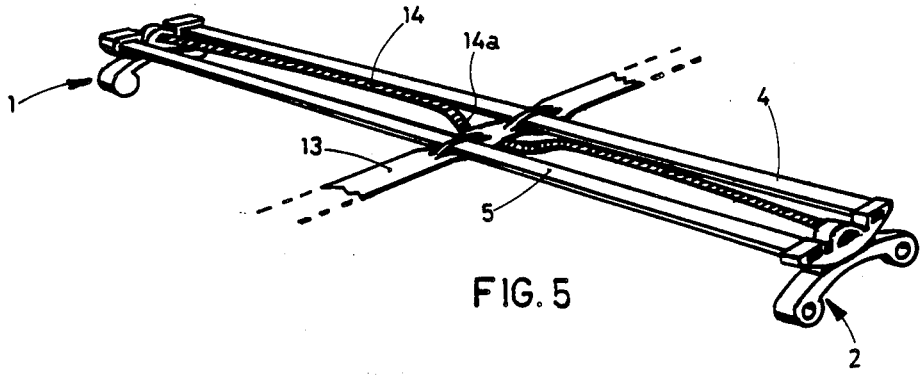
FIG. 5
FIG. 6
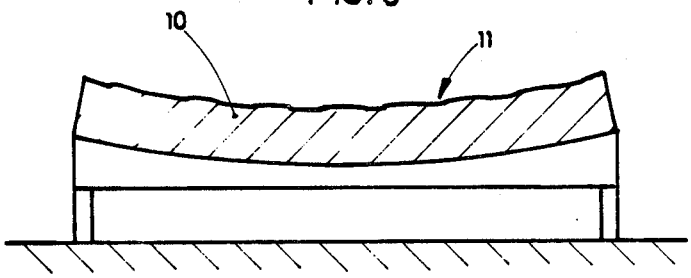
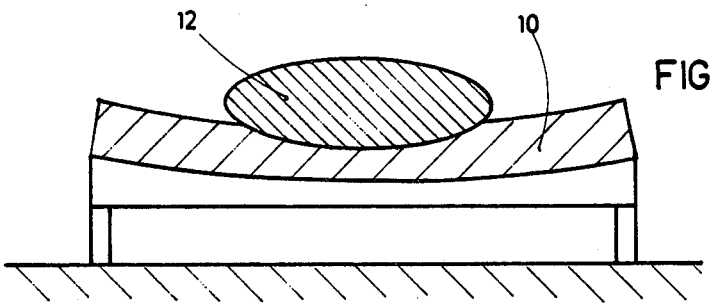
FIG. 7

UNDERMATTRESS USING PAIRED SLATS AND AN ELASTIC SUPPORTING MEMBER

The invention relates to an undermattress having a device for temporarily ventilating a mattress, lying on a slatted framework, in order to facilitate the evaporation of the moisture adhering to the mattress.

It is a fact known to every housewife that a mattress absorbs moisture from its environment in the course of time and has to be aired periodically for this reason. Since the moisture collects in particular in the lower mattress area lying on the undermattress, it is generally recommended turning the mattress or setting it up on end temporarily for the purpose of airing on all sides. Such airing should be carried out at least once a week.

For many housewives, handling the relatively heavy mattress involves a laborious effort which in many cases is downright unreasonable, so that airing is frequently carried out either only at long intervals or ceases altogether.

In order to absorb moisture accumulating in the mattress area, the proposal has already been made to provide the mattress body with hollow spaces and to accommodate moisture-absorbing wicks inside the latter. Materials with a high moisture-absorbing capacity are also preferentially used as mattress covers.

Although these known measures brought about a noticeable reduction in moisture, they could not, however, prevent the support area of the mattress, i.e. the contact surface between the mattress and the supporting elements (e.g. wooden spring bridges) of the undermattress, from continuing to give rise to the formation (condensation) and accumulation of moisture. A mattress-support system which effectively removes this disadvantage and guarantees continual mattress airing could not be realized with the previously known means.

It is therefore the object of the present invention to propose a device of the type mentioned which guarantees the desired airing of the mattress underside, spares the housewife the laborious handling of the mattress and nevertheless enables the proven supporting systems (undermattress with slatted framework) to be retained. This object is achieved by the feature combination defined in the independent patent claim 1. Preferred embodiments follow from the dependent patent claims.

Thanks to this development of the undermattress, the mattress is continually aired, as long as it is lifted in the unloaded condition from the supporting surfaces of the undermattress.

A further advantage which results in this connection can be seen in the fact that the supporting elements (wooden slats, spring bridges) of the undermattress now no longer need to be bent convexly upwards for aesthetic reasons. As a result of the mattress lifter, the sheet stretching over the mattress is in every case stretched, independently of the form of the supporting elements located thereabove, in such a way that the unloaded reclining surface shows the desired convex curvature.

Thus the requirement made recently by the physiology of sleep that the reclining surface, with regard to the optimum "embedding" of the sleeping person, should have a slight, downwardly directed concave bend can now be fulfilled. Thanks to this concavity, an excess of cover material results in the loaded condition of the mattress in the area of the reclining surface, which cover material, however, when the load decreases, is arched upwards again by the mattress lifters and thereby rigidly stretched.

An exemplary embodiment of the subject matter of the invention, including several design variants, is described below with reference to the attached drawing.

Figure 2:
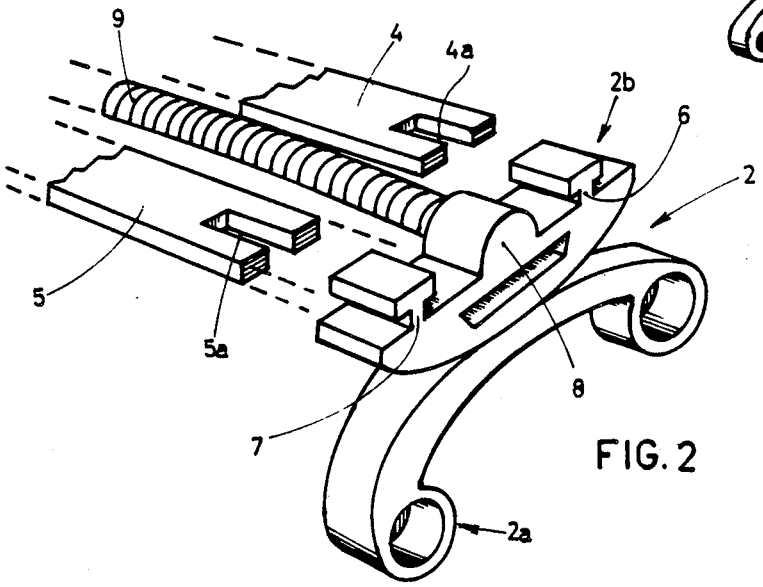
Figure 3:
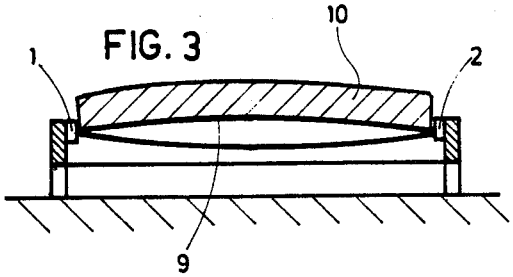
Figure 4:
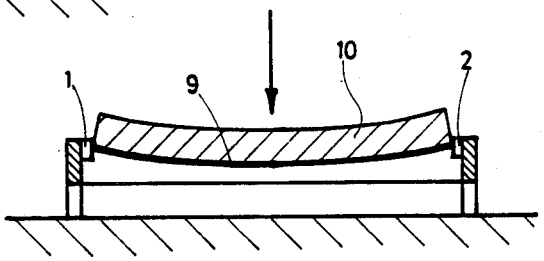
Figure 8:
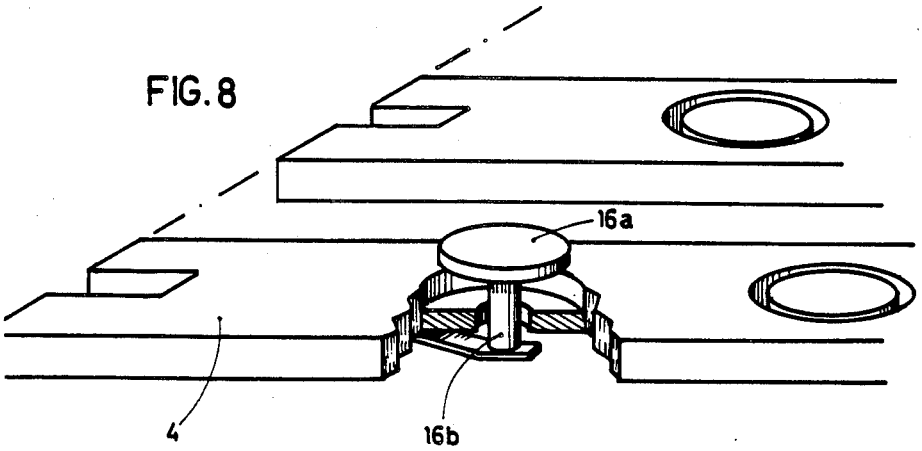
Figure 9:
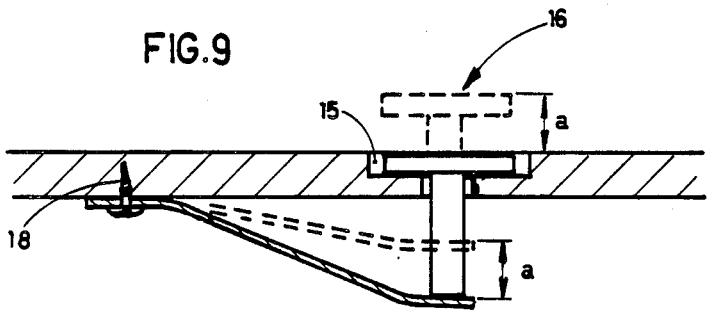
Figure 10:
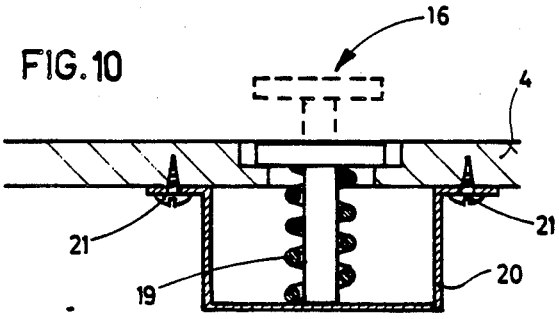
Figure 11:
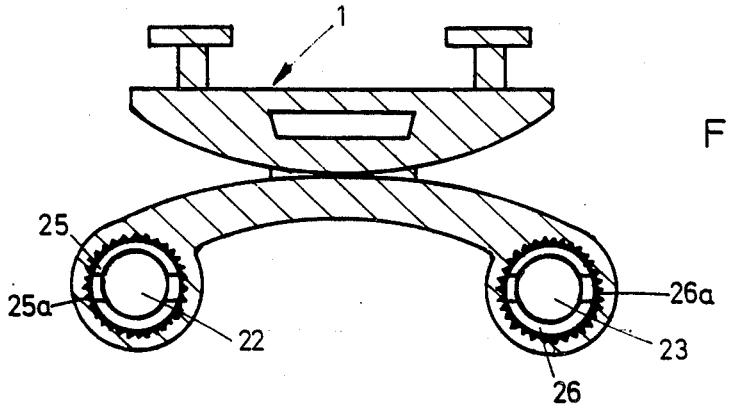
Figure 12:
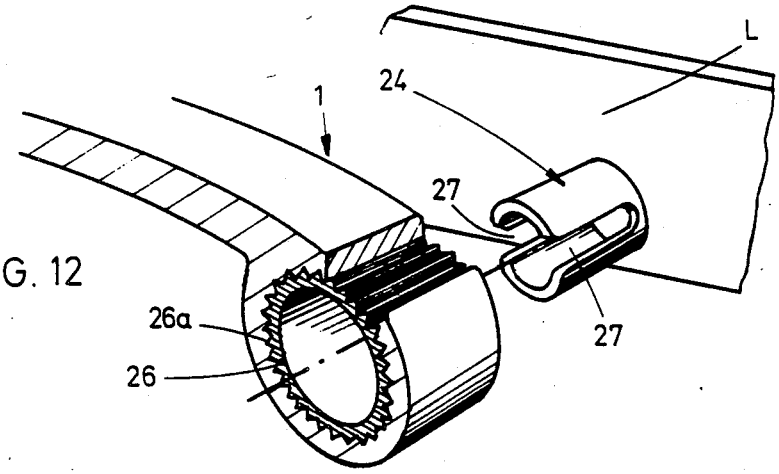

FIG. 1 shows a perspective view of the spring bridge of an undermattress with the associated supporting elements, FIG. 2 is an enlarged perspective representation of the attachment point of the spring bridge on a supporting element, FIGS. 3 and 4 are schematic sectional representations of a piece of reclining furniture in the unloaded and loaded condition, FIG. 5 shows a spring bridge with a variant of a mattress lifter, FIG. 6 illustrates the deformation of the upper mattress cover or sheet during bending, FIG. 7 shows the consequence of the deformation shown in FIG. 6 on the embedment of the sleeping person, FIG. 8 is a perspective representation of a further embodiment variant, FIG. 9 is a section of the variant shown in FIG. 8, FIG. 10 shows a further design modification of the mattress-lifter principle, FIG. 11 is a sectional representation of an elastomeric supporting element, and FIG. 12 shows a perspective view of an embodiment detail of the supporting element shown in FIG. 11.

According to FIG. 1, the elastomeric supporting elements 1 and 2 of a spring bridge are anchored in the longitudinal side walls (not shown) of a frame of a piece of reclining furniture via in each case two pins 3. The supporting elements 1 and 2 are made in the form of a double cradle which has a lower part 2*a*, which can be fixed to the frame of the piece of reclining furniture, and an upper part 2*b* constructed in one piece with the lower part 2*a*. The upper part 2*b* can be pivoted in known manner about its centre fixing area, and, in interaction with the elastomeric mobility of the lower part, the desired, optimum mounting of the plywood springs 4 and 5 is thus obtained. The latter, as shown by FIG. 2, are detachably fixed by frictional connection with their grooves 4*a* and 5*a* in corresponding retaining webs 6 and 7 respectively of the supporting element 1 or 2.

In its center area, the upper part 2*b* of each supporting body 2 has a mount 8 which is made in the form of a locating pocket and the cross-section of which corresponds to that of a lifting slat 9. The latter can have a round or polygonal cross-sectional shape and, according to the exemplary embodiment shown, is made as a half-round bar. Moreover, the lifting slat 9, as FIG. 1 clearly shows, is adapted in its length to the mutual distancing of a mount pair 8 such that it arches upwards in the unloaded condition and still essentially retains this arching even when the mattress lies on the undermattress. Only when the mattress is loaded by a reclining person does the lifting slat bend downwards until the mattress lies on the plywood springs 4 and 5. The axial extension resulting downwards when the lifting slat 9 bends is absorbed by the elastomericity of the supporting elements, but can also be completely or partly compensated by the lifting slat bending slightly to the side out of its vertical plane.

The lifting slat 9 is preferably made of a plastic or wood, but other materials, for example light metal can also be used. In general, it probably suffices for one portion, for example about 50%, of all spring bridges to be equipped with a lifting slat, but there is nothing to prevent all spring bridges being so equipped.

The elastic bending of the lifting slat 9 is in any case to be adapted to the overall weight of the mattress in such a way that the lifting slats project above the upper edge of the plywood springs when the mattress is not loaded and in doing so hold the mattress at a distance above the spring bridges, but fall back onto or below the upper edge of the plywood springs when the mattress is loaded.

The pocket-shaped mount 8, used for accommodating the lifting-slat ends, can be provided with a through assembly opening according to FIG. 1 or, as shown by FIG. 2, with a blind hole closed at one side. In the very first case, the slat end must sit fully in the mount 8 with frictional contact.

Thanks to the undermattress development described, the mattress remains lifted in the unloaded condition, i.e. normally during the day, by the plywood springs 4 and 5, so that its underside is also freely aired except for the small supporting surfaces of the lifting slats 9.

However, apart from the improved airing capacity, the use of the lifting slats 9 also brings about a further advantage: FIGS. 3 and 4 show a mattress 10 on a frame 11 of a piece of reclining furniture. According to FIG. 3, the unloaded mattress 10 is lifted upwards by the lifting slats 9, whereas according to FIG. 4 it lies under load on the spring bridges. In this preferred embodiment, the latter are curved slightly downwards, which, although advantageous for sleeping comfort, could not be realized previously because the unloaded bed presented an unsightly appearance during the day when the mattress sagged. Because of the lifting slats 9, however, not only is the mattress 10 now lifted, but a tight and smooth sheet is obtained at the same time.

This fact is illustrated again in detail in FIGS. 6 and 7, with details of the undermattress being omitted for the sake of simplicity. According to FIG. 6, when the mattress 10 sags, an excess of material forms on its upper side because the mattress cover or sheet is pushed together, so that the schematically represented body 12 of the sleeping person is much better embedded on the mattress than would be the case on a flat, tightly stretched reclining surface.

A design variant of a mattress lifter is shown in FIG. 5. The mattress lifter 14 must be given a special form, because in this case the plywood springs 4 and 5 mounted in the elastic supporting bodies 1 and 2 are connected to one another by a center strap 13 which extends over the entire length of the piece of reclining furniture. As the Figure shows, the half-round bar anchored on both sides in the supporting bodies 1 and 2 is bent downwards in its center area, so that this center area grips beneath the center strap 13. On both sides of the center area, the two legs of the mattress lifter 14 project above the upper edge of the plywood springs 4 and 5 and, as in the embodiment already described, fall back below this plane when the mattress is loaded.

The previously described exemplary embodiments can be modified by the specialist in diverse manner within the framework of the inventive idea. Therefore it is of course not necessary for the mattress lifter to extend over the entire width of the piece of reclining furniture from one supporting body to the other, nor is it really necessary for it to be arranged in the intermediate space between two adjacent plywood springs. FIGS. 8 and 9 illustrate such a design development possibility.

Accordingly, the plywood spring 4 itself is provided with a stepped bore 15 in which a mushroom-shaped lifting pin 16 is mounted in resilient manner. According to this embodiment, the lifting pin, provided with a support head **16*a* and a retaining pin 16*b*, is fixed on the end portion of a leaf spring 17 which is screwed in turn onto the underside of the plywood spring 4 by means of a screw 18. When the mattress is unloaded, the lifting pin 16 therefore assumes the position shown in broken lines in FIG. 9, whereas it gives way downwards by the height a against the restoring force of the leaf spring 17**.

As further shown by FIG. 10, such a lifting pin 16 can also be elastically pretensioned by a helical spring 19 which is supported on a supporting flange 20 which is screwed in turn onto the plywood spring 4 via screws 21.

Because of the different loading of the individual lifting slats 9 (FIG. 2) which does not always act downwards only in the vertical direction, which lifting slats 9 are of course mounted together with the plywood springs are of course mounted together with the plywood springs 4 and 5 in the same supporting elements 1 and 2, individual lifting slats 9 may be liable to become bent out of their vertical planes. The lateral forces causing this undesirable movement can be neutralised, as tests have shown, by a special design measure which relates to the mounting of the supporting elements 1 and 2.

According to FIGS. 11 and 12, the supporting element 1 selected as an example has two openings 22 and 23, by means of which the supporting element 1 is pushed onto two pins 24 fixed onto the longitudinal side wall L of the bed frame. The openings 22 and 23 are lined with sliding bushes 25 and 26 which, with their toothed profile **25*a* and 26*a***, are pushed into the openings of the elastomeric supporting element.

Thanks to this design, the above-mentioned undesirable lateral forces acting on the lifting slats 9 are absorbed by the resilient supporting elements, so that the lifting slats 9 remain in their vertical plane practically independent of the particular loading direction.

Thanks to this measure, a reduction in the elastic restoring resistance inherent in the elastic supporting elements 1 and 2 results. The contact of the spring-bridge upper sides on the mattress underside is thereby considerably improved.

The mobility of the pins 24 inside the sliding bushes 25 and 26 made of slidable plastic can be further improved by the pins 24 also being made of slidable plastic and having moreover, at least one longitudinal slot 27 running parallel to their longitudinal axis. In the embodiment shown in FIG. 12, two of such longitudinal slots 27 are provided, as a result of which, on the one hand, an excessive surface pressure inside the sliding bush 26 is avoided and, on the other hand, insertion of the pin 24 into the sliding bush 26 is facilitated.

I claim:

1. An undermattress adapted to support a mattress thereon, said undermattress comprising a slatted framework which includes a plurality of slats, said slats being arranged in pairs and being interconnected to each other by a strap extending between opposed ends of said slats, and a plurality of elastic members, each of said elastic members being mounted between the slats of a corresponding pair of slats and having a first end portion on one side of said strap, a second end portion on an opposite side of said strap and a central portion located between said first and second end portions and extending beneath said strap, said first and second end portions extending above said slats of said corresponding pair of slats so as to maintain the mattress above and out of substantial contact with said slats of said corresponding pair of slats when the mattress is not supporting an individual in a reclined position, whereby the mattress is temporarily ventilated so as to facilitate the evaporation of moisture adhering thereto, and each of said elastic members having an elasticity selected such that the weight of an individual supported on the mattress in a reclined position deflects said first and second end portions of said elastic members to such an extent that the mattress rests substantially on said slatted framework, whereby said elastic members do not impair the physiologically correct support of an individual lying on the mattress in a reclined position.

2. An undermattress according to claim 1, further comprising a frame having a first longitudinal side wall, a second longitudinal side wall, first supporting means attached to said first longitudinal side wall for supporting one end of each of said slats and one end of each of said elastic members and second supporting means attached to said second longitudinal side wall for supporting an opposite end of each of said slats and an opposite end of each of said elastic members, whereby said elastic members extend completely across said frame.

3. An undermattress according to claim 1 or 2, further comprising adhering means for adhering said elastic members to the mattress, said adhering means including a layer of adhesive provided on an upper surface of each of said elastic members.

4. An undermattress according to claim 2, wherein said first supporting means includes a plurality of first supporting elements, one for each pair of said slats, each of said first supporting elements being mounted on said first longitudinal side wall of said frame by a corresponding pair of first bearing pins extending inwardly from said first longitudinal side wall of said frame, each pair of said first bearing pins being rotatably received in a corresponding pair of first openings provided in a corresponding one of said first supporting elements, each of said first openings having a first sliding bushing to thereby facilitate the rotational movement of said first bearing pins in said first openings, and wherein said second supporting means includes a plurality of second supporting elements, one for each pair of said slats, each of said second supporting elements being mounted on said second longitudinal side wall of said frame by a corresponding pair of second bearing pins extending inwardly from said second longitudinal side wall of said frame, each pair of said second bearing pins being rotatably received in a corresponding pair of second openings provided in a corresponding one of said second supporting elements, each of said second openings having a second sliding bushing to thereby facilitate the rotational movement of said second bearing pins in said second openings.

5. An undermattress according to claim 4, wherein each of said first and second sliding bushings has an outer surface which is provided with a plurality of teeth.

6. An undermattress according to claim 4 or 5, wherein each of said first and second bearing pins is made of plastic and has at least one longitudinally extending slot.

7. An undermattress aooording to claim 4, wherein only some of said pairs of slats have said elastic members associated therewith.

8. An undermattress according to claim 4, wherein all of said pairs of slats have said elastic members associated therewith.

9. An undermattress according to claim 1, wherein each of said elastic members has a semi-circular transverse cross-sectional shape which provides said elastic member with a rounded upper surface and a flat lower surface.

10. An undermattress according to claim 9, wherein said rounded upper surface of each of said elastic members is provided with an adhesive to thereby better adhere said elastic members to the mattress.

11. An undermattress according to claim 1, wherein said first and second end portions of said elastic members are bowed when the mattress is not supporting an individual in a reclined position.

* * * * *